US007823634B2

(12) United States Patent
Chan et al.

(10) Patent No.: US 7,823,634 B2
(45) Date of Patent: Nov. 2, 2010

(54) WELLHEAD ISOLATION SLEEVE ASSEMBLY

(75) Inventors: Kwong Onn Chan, Edmonton (CA); Henry X He, Edmonton (CA); Eugene A Borak, Jr., Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 277 days.

(21) Appl. No.: 11/867,086

(22) Filed: Oct. 4, 2007

(65) Prior Publication Data

US 2009/0090515 A1 Apr. 9, 2009

(51) Int. Cl.
*E21B 19/00* (2006.01)
*E21B 33/04* (2006.01)

(52) U.S. Cl. ..... 166/86.3; 166/80.1

(58) Field of Classification Search ..... 166/86.1, 166/86.3, 80.1, 82.1, 84.4; 277/513, 327, 277/337

See application file for complete search history.

(56) References Cited

U.S. PATENT DOCUMENTS 1,896,236 A * 2/1933 Howard et al. ..... 166/80.1
1,983,854 A * 12/1934 Howard et al. ..... 166/80.1
3,328,040 A * 6/1967 Prichard ..... 277/327
3,840,072 A * 10/1974 Hutchison ..... 166/84.1
4,178,020 A * 12/1979 Dopyera ..... 285/18
5,819,851 A 10/1998 Dallas
5,975,211 A 11/1999 Harris
6,516,861 B2 2/2003 Allen
6,810,954 B2 11/2004 Garrett et al.
7,040,412 B2 5/2006 DeBerry
2003/0205385 A1 11/2003 Duhn et al.
2006/0185841 A1 * 8/2006 Swagerty et al. ..... 166/88.1

* cited by examiner

*Primary Examiner*—David J Bagnell
*Assistant Examiner*—Cathleen R Hutchins
(74) *Attorney, Agent, or Firm*—Bracewell & Giuliani

(57) ABSTRACT

An isolation sleeve extends from an adapter into the bore of a tubing head to isolate high pressure frac fluid from the body of the tubing head. The isolation sleeve may be moved into and out of the bore by a hydraulic transfer piston or it may be installed and retrieved by a running tool. The isolation sleeve has a seal carrier on its lower end. The seal of the seal carrier may seal to a secondary packoff in the tubing head, on the outer diameter of the conduit, or to the rim of the conduit. The seal carrier may be movable relative to the sleeve to energize the seal.

7 Claims, 6 Drawing Sheets

WELLHEAD ISOLATION SLEEVE ASSEMBLY

FIELD OF THE INVENTION

This invention relates in general to protecting a wellhead from high pressure and abrasive fluids imposed during a well fracturing operation.

BACKGROUND OF THE INVENTION

One type of treatment for an oil or gas well is referred to as well fracturing or a well "frac." The operator connects an adapter to the upper end of a wellhead member such as a tubing head and pumps a liquid at a very high pressure down the well to create fractures in the earth formation. The operator also disburses beads or other proppant material in the fracturing fluid to enter the cracks to keep them open after the high pressure is removed. This type of operation is particularly useful for earth formations that have low permeability but adequate porosity and contain hydrocarbons, as the hydrocarbons can flow more easily through the fractures created in the earth formation.

The pressure employed during the frac operation may be many times the natural earth formation pressure that ordinarily would exist For example, the operator might pump the fluid at a pressure of 8,000 to 9,000 psi. The normal pressure that might exist in the wellhead might be only a few hundred to a few thousand psi. Because of this, the body of the wellhead and its associated valves typically may be rated to a pressure that is much lower than what is desired for the frac operation, such as 5,000 psi. While this is sufficient to contain the normal well formation pressures, it is not enough for the fluid pressure used to fracture the earth formation.

Moreover, because of the proppant material contained in the frac fluid, the frac fluid can be very abrasive and damaging to parts of the wellhead. To allow the operator to use a pressure greater than the rated capacity of the wellhead seals (including the various valves associated with the wellhead) and to protect against erosion resulting from the frac fluid being pumped at high pressure and volume into the well, the operator may employ an isolation sleeve to isolate these sensitive portions of the wellhead from the frac fluid. An isolation sleeve seals between an adapter above the wellhead and the casing or tubing extending into the well. The sleeve isolates the high pressure, abrasive fracturing fluid from those portions of the wellhead that are most susceptible to damage from the high pressures and abrasive fluids used in well fracturing operations. A variety of designs exists and has been proposed in the patented art. While some are successful, improvements are desired.

SUMMARY OF THE INVENTION

An isolation sleeve is carried by running tool or an adapter assembly for insertion into the bore of a wellhead. The wellhead is the surface termination of a wellbore and typically includes a casing head for installing casing hangers during the well construction phase and (when the well will be produced through production tubing) a tubing head mounted atop the casing head for hanging the production tubing for the production phase of the well. The casing in a well is cemented in place in the hole that is drilled and serves as a liner for the hole. The fluids from the well may be produced through the casing or, frequently, through production tubing, which is a string of smaller diameter pipe that runs inside the casing from the wellhead to the downhole formation from which the fluids are being produced. In two of the embodiments, the isolation sleeve has a seal carrier on its lower end that supports a seal recessed within the interior of the seal carrier. The seal carrier fits over the outer diameter of the well conduit (e.g., casing or tubing) extending upward into the wellhead member. In one of the embodiments, the seal carrier has an energizing piston that, when supplied with hydraulic fluid, moves the seal carrier downward, energizing the seal against the rim of the well conduit.

In the other embodiment, the seal carrier is rigidly attached to the isolation sleeve. The seal is located within an annular recess in the seal carrier. A mandrel with an external annular piston is carried inside the sleeve. An engaging member is located between the mandrel and the seal. When hydraulic pressure is supplied to the energizing piston, it pushes the engaging member down to energize the seal against the outer diameter of the conduit.

The isolation sleeve of each of these two embodiments may be configured to be retrieved from the wellhead by lowering a retrieval tool into the adapter. Alternately, the sleeve could be stroked into and out of contact with the well conduit by a piston arrangement. In one such embodiment, the adapter has an integral body that includes a gate valve and a hydraulic chamber located above the gate valve. A hydraulic annular piston drives the isolation sleeve between a lower position in a sealing relationship with the well conduit and an upper position. In the upper position, the seal member on the lower end of the sleeve is located above the gate of the valve. In another embodiment, the gate vale and the hydraulic piston assembly may not be integral, but may be two separate assemblies. This would permit retrieval of the isolation sleeve while the gate valve is closed and in place on the wellhead after the frac operation has been competed.

DETAILED DESCRIPTION OF THE INVENTION

Figure 1:
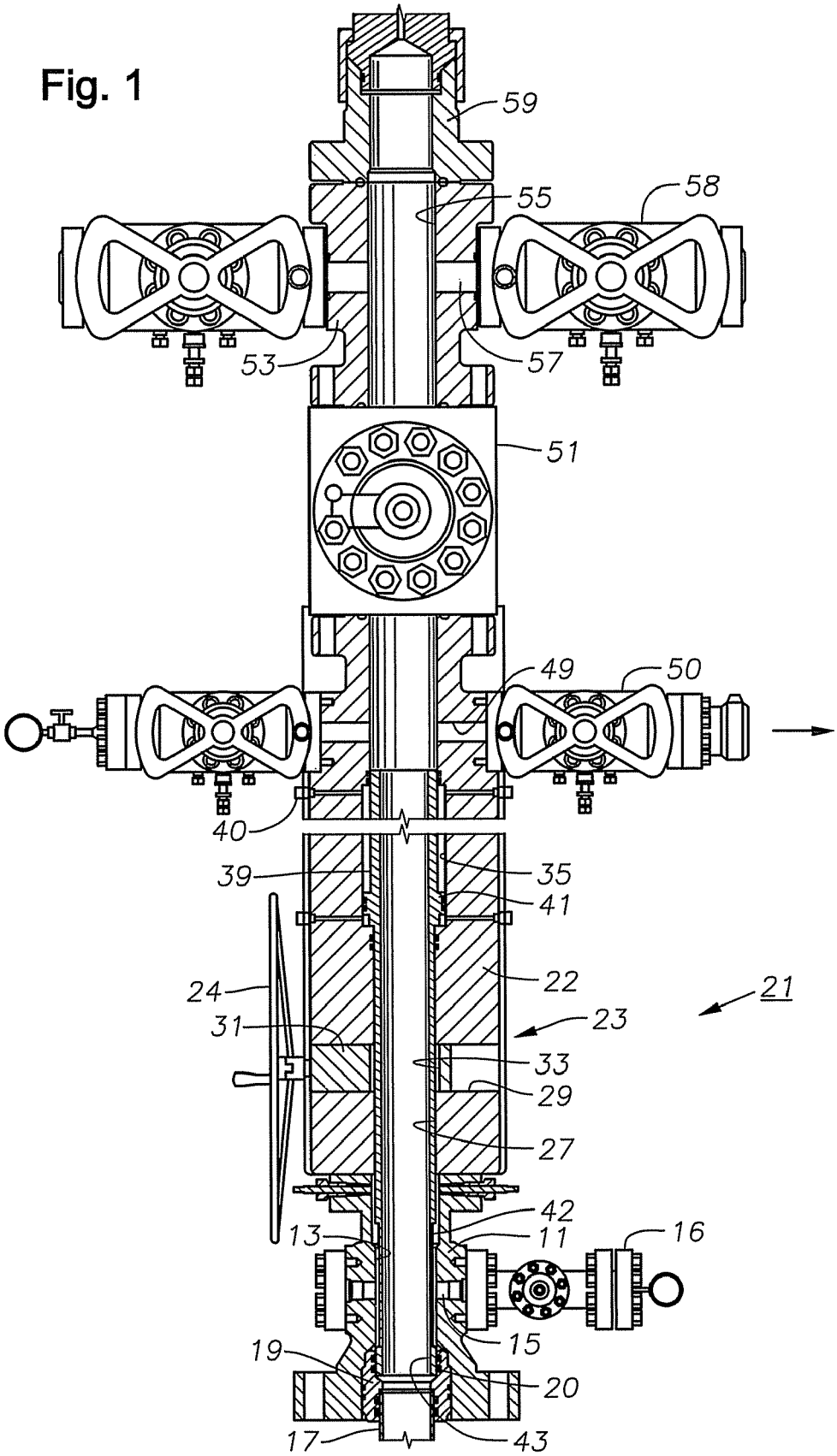
FIG. 1 is a sectional view illustrating a well fracturing assembly including an adapter assembly connected to a wellhead for a frac operation, the adapter assembly being constructed in accordance with one embodiment of the invention.

Referring to FIG. 1, the wellhead 11 has a bore 13 extending vertically through it (the lower portion of the wellhead is not shown). The wellhead 11 has one or more production outlets 15 that extend laterally from it for the flow of well fluid during production. A wing valve 16 is located in production outlet 15. The upper end of the string of casing 17 extends upward into bore 13. The casing is supported by a casing hanger (not shown).

A secondary packoff 19 in the wellhead bore 13 seals the annular space between casing 17 and wellhead 13. In this example, secondary packoff 19 has a set of seals 20 in an enlarged counterbore above the upper end of casing 17. The upper end of casing 17 is below production outlet 15.

To perform a frac operation, an adapter assembly 21 is mounted on the wellhead 11. In this example, adapter assembly 21 has an integral, solid body 22 that includes components of a gate valve 23. A passage or bore 27 extends vertically through body 22 in coaxial alignment with wellhead bore 13. Adapter body 22 has a transverse gate cavity 29 that intersects and is perpendicular to bore 27. A gate 31 is located in gate cavity 29 and slides from an open position shown in FIGS. 1 and 2 to a closed position shown in FIG. 3. A handle 24 is rotated to cause the movement between open and closed positions; a remotely controlled valve actuator (not shown) also may be used for this purpose. Gate 31 has a hole or bore 33 extending through it that registers with adapter body bore 27 while in the open position and is misaligned while in the closed position. Gate valve 23 is shown schematically, and would have other conventional components, such as seat rings and seals.

Adapter body 22 includes a hydraulic chamber 35, which comprises an enlarged diameter portion of bore 27 above gate 31. The upper end of an isolation sleeve 39 is located within chamber 35. Sleeve 39 has an annular piston 41 formed on its exterior that slides and seals against the wall of chamber 35. A portion of sleeve 39 extends above piston 41 and engages seals in bore 27 above chamber 35. The annular space above and below piston 41 in chamber 35 moves piston 41 downward or upward when supplied with hydraulic fluid under pressure through ports 40*a* and 40*b*, respectively, that lead from the exterior of body 22 to upper and lower ends of chamber 35, respectively. Piston 41 will be referred to herein as a transfer piston because it moves sleeve 39 between upper and lower positions.

Figure 2:
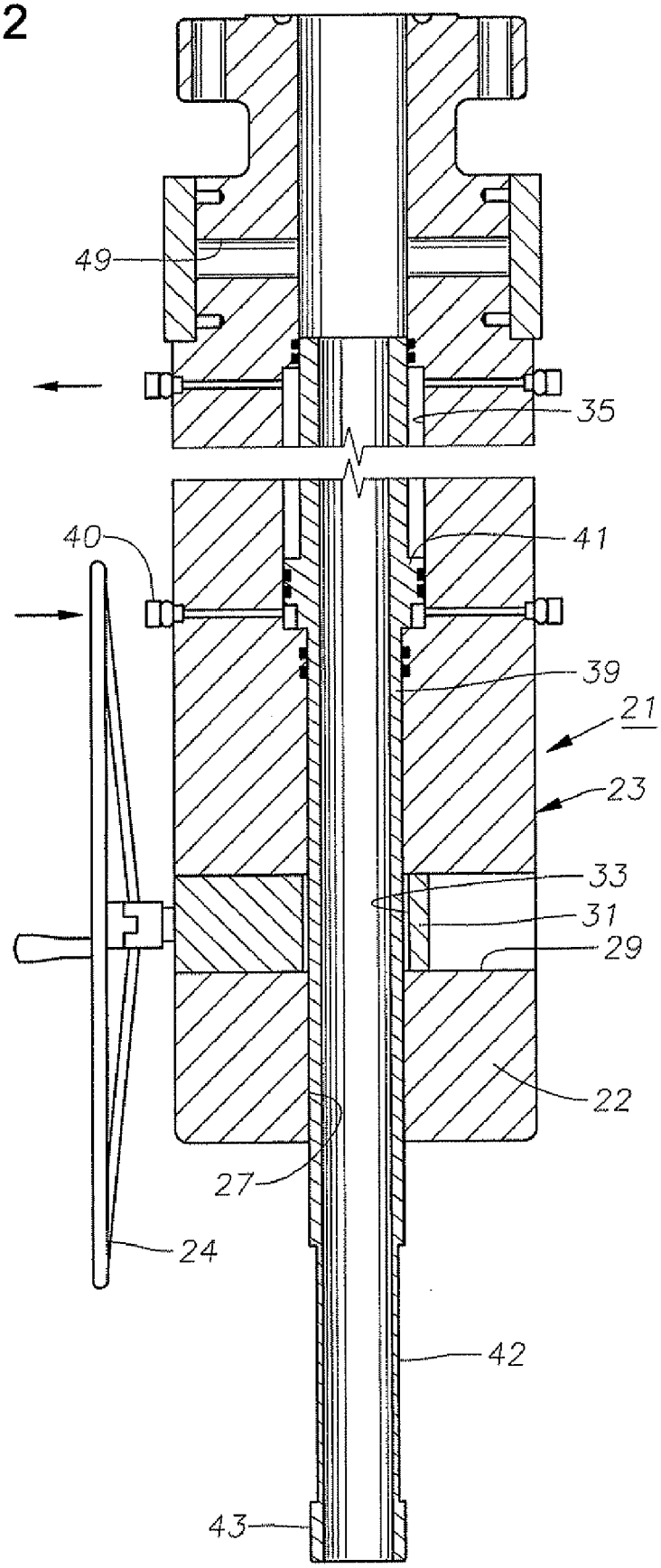
FIG. 2 is an enlarged sectional view of a portion of the adapter assembly in FIG. 1 shown removed from the wellhead and showing the isolation sleeve in a lower position.
Figure 3:
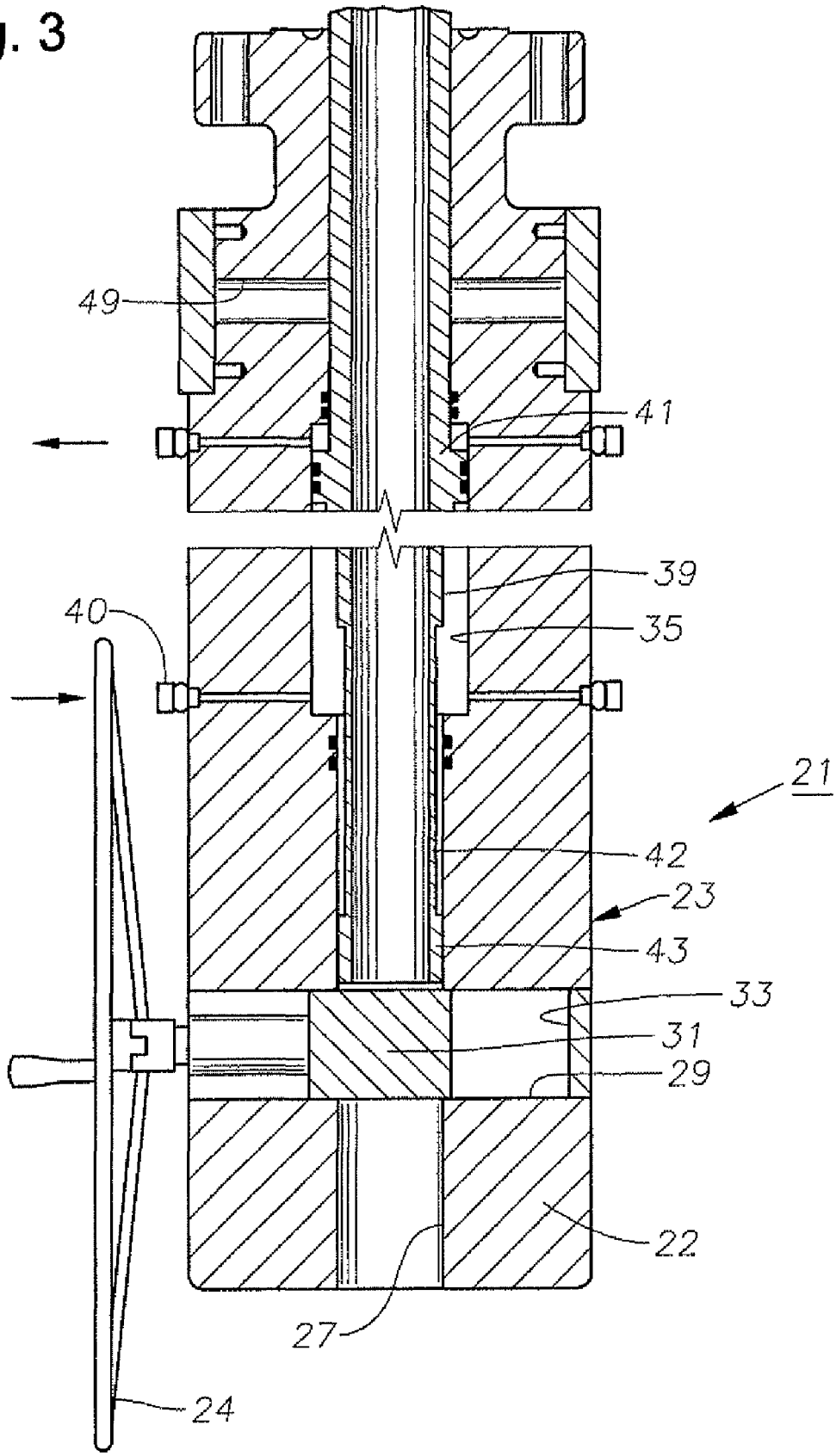
FIG. 3 is a sectional view of the adapter assembly of FIG. 2, with the sleeve shown in an upper position.

A seal carrier 42 is located on the lower end of sleeve 39. In this example, seal carrier 42 is integrally formed with sleeve 39 and has a cylindrical seat 43 located on the lower end; however, seal carrier 42 may be a separate cylindrical component which may be attached to the lower end of sleeve 39. In the embodiment of FIGS. 1-3, seat 43 comprises a cylindrical metal surface on the exterior of seal carrier 42 for sealing against seals 20 in secondary packoff 19. The inner diameters of sleeve 39 and seal carrier 42 are preferably the same and no smaller than the inner diameter of casing 17. As shown in FIGS. 2 and 3, in this example, the portion of seal carrier 42 above seat 43 may have a thinner wall thickness than seat 43 and than sleeve 39.

One or more passages 49 extend radially from adapter body bore 27 to the exterior of the adapter above chamber 35 forming a lower manifold. A valve 50 is connected to each passage 49. In this example, an upper master valve 51 is mounted to the upper end of adapter body 22. Upper master valve 51 is preferably a gate valve and will open and close access to bore 27 in adapter body 22. An upper manifold 53 is mounted on upper master valve 51. Upper manifold 53 has an axial bore 55 and one or more transverse passages 57; each transverse passage being connected to a valve 58. A cap 59 is located on the upper end of upper manifold 53 sealing the upper end of axial bore 55.

In the operation of the embodiment of FIGS. 1-3, the well typically is a new well that has been drilled and lined with casing 17. Adapter assembly 21 also could be employed for remedial operations on existing wells. The operator places sleeve 39 in the upper position shown in FIG. 3 and installs adapter assembly 21 on the upper end of wellhead 11. The operator may choose to perforate casing 17 at this point by lowering perforating guns through adapter assembly 21. Alternately, if the internal formation pressure is known to be sufficiently low, the operator may choose to perforate before installing adapter assembly 21.

The operator installs upper master valve 51 on adapter body 22 and upper manifold 53 on upper master valve 51. The operator connects flowlines from frac pumps (not shown) to valves 50 and 58, opens valve 23, and supplies hydraulic pressure through upper hydraulic port 40*a* to stroke piston 41 downward. When stroked downward, seat 43 will sealingly engage seals 20 of secondary packoff 19, as shown in FIG. 1.

The operator opens master valve 51 and operates the frac pumps to supply high pressure frac fluid through valve(s) 58 while valve(s) 50 remain closed. The frac fluid flows out through the perforations in the casing into the earth formation. Sleeve 39 isolates the frac fluid from the body of wellhead 11.

After the frac operation has been completed, typically the operator closes master valve 51, opens valve(s) 50, and allows the frac fluid to vent back through valve(s) 50. The operator may wish to then set a bridge plug in casing 17 above the lowest perforations, perforate the casing in a higher zone, and repeat the frac procedure. The bridge plug and perforating guns may be run on wireline by removing cap 59 and lowering them through adapter bore 27. This frac procedure may be repeated several times if desired.

When fracturing is complete, the operator will supply hydraulic fluid pressure to the lower port 40*b*, which strokes transfer piston 41 upward to the uppermost position, which places seal 43 above gate 31, as shown in FIG. 3. The operator then closes valve 23 and can remove the adapter assembly 21, upper master valve 51, upper manifold 53, and cap 59 for use at another well site. The operator could then complete the well by drilling out the plugs and installing tubing and a Christmas tree on top of wellhead 11.

Figure 4:
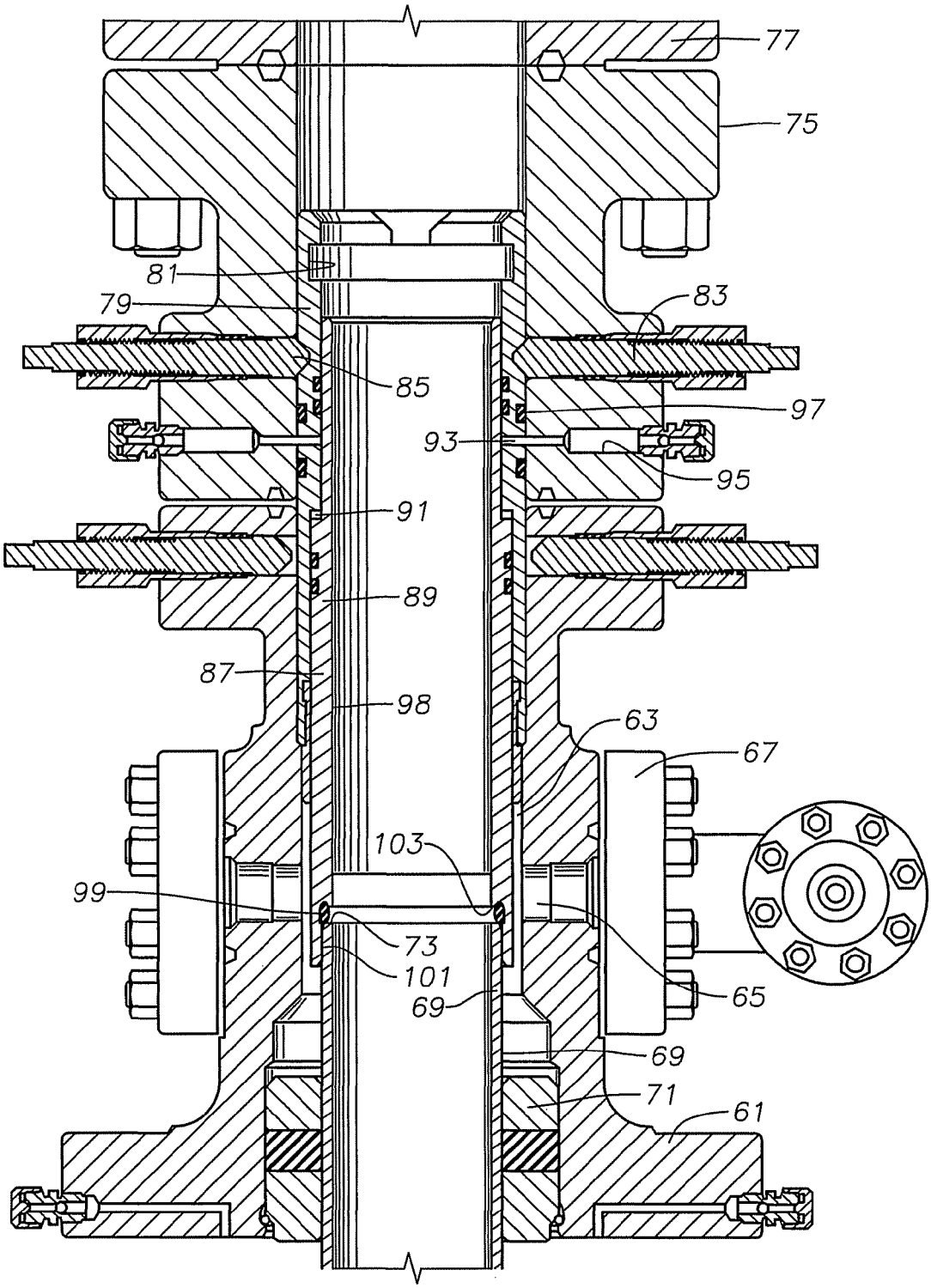
FIG. 4 is a sectional view of another embodiment of an isolation sleeve engaging a conduit in a wellhead.

A second embodiment of the invention is illustrated in FIG. 4. Wellhead 61 has a bore 63 with an enlarged portion at the lower end of wellhead 61. One or more production passages 65 extend from bore 63 laterally outward to a wing valve 67. The upper end of a string of production casing 69 extends upward from a casing hanger (not shown) and is sealed to wellhead 61 by a secondary packoff71. In this embodiment, the upper end of casing 69 protrudes above packoff 71 and has a rim 73 that is located slightly below production passage 65.

Adapter body 75 mounts on top wellhead 61, and a separate gate valve 77 is shown mounted on top of adapter 75 in this example. An isolation sleeve 79 is secured in the bore of adapter 75 and extends downward into bore 63. In the embodiment of FIG. 3, sleeve 79 may be run into and retrieved from adapter 75 and has a profile 81 on its upper end for engagement by a running tool (not shown). When in the engaged position shown in FIG. 3, lock screws 83 mounted in threaded holes in adapter body 75 can be rotated into engagement with an annular groove 85 on sleeve 79. Sleeve 79 has an inner diameter that is no smaller than the inner diameter of casing 69.

A seal carrier 87 is carried inside sleeve 79. Seal carrier 87 is a tubular member having an inner diameter no smaller than the inner diameter of casing 69. An energizing piston 89 is integrally formed on the exterior of seal carrier 87. Energizing piston 89 is located within an annular chamber 91 formed in sleeve 79. Energizing piston 89 has seals on its outer diameter that sealingly engage the wall of chamber 91 of sleeve 79. One or more sleeve ports 93 extend through sleeve 79 and registers with adapter port 95 extending radially through adapter body 75. Annular seals seal the exterior of isolation sleeve 79 and the interior of the well head above and below adapter port 95. Hydraulic fluid pressure supplied to adapter port 95 will flow through sleeve port 93 and into chamber 91 to stroke seal carrier 87 downward relative to isolation sleeve 79.

A seal 99 is located within a recess 101 formed in the bore of seal carrier 87. Recess 101 is defined by a downward facing shoulder 103 on the upper end. The lower end of recess 101 is open and is no smaller than the outer diameter of casing 69 so that it can slide over the upper end casing 69. Seal 99 has a lower side that contacts casing rim 73. Hydraulic pressure applied to energizing piston 89 energizes seal 99 against casing rim 73 to provide a sealing engagement beteen seal carrier 87 and the upper end of casing 69.

In the embodiment of FIG. 4, the operator installs adapter 75 on wellhead 61. The same arrangement of lower and upper manifolds and an upper gate valve, similar to what is shown in FIG. 1 but not having the hydraulic chamber or isolation sleeve, would be mounted on gate valve 77. Sleeve 79 could be installed in advance or run in by a running tool. The operator supplies hydraulic fluid pressure through adapter port 95 to lower seal carrier 87 into sealing engagement with rim 73 and energize seal 99. The frac operation is performed in the same manner as in the first embodiment.

Figure 5:
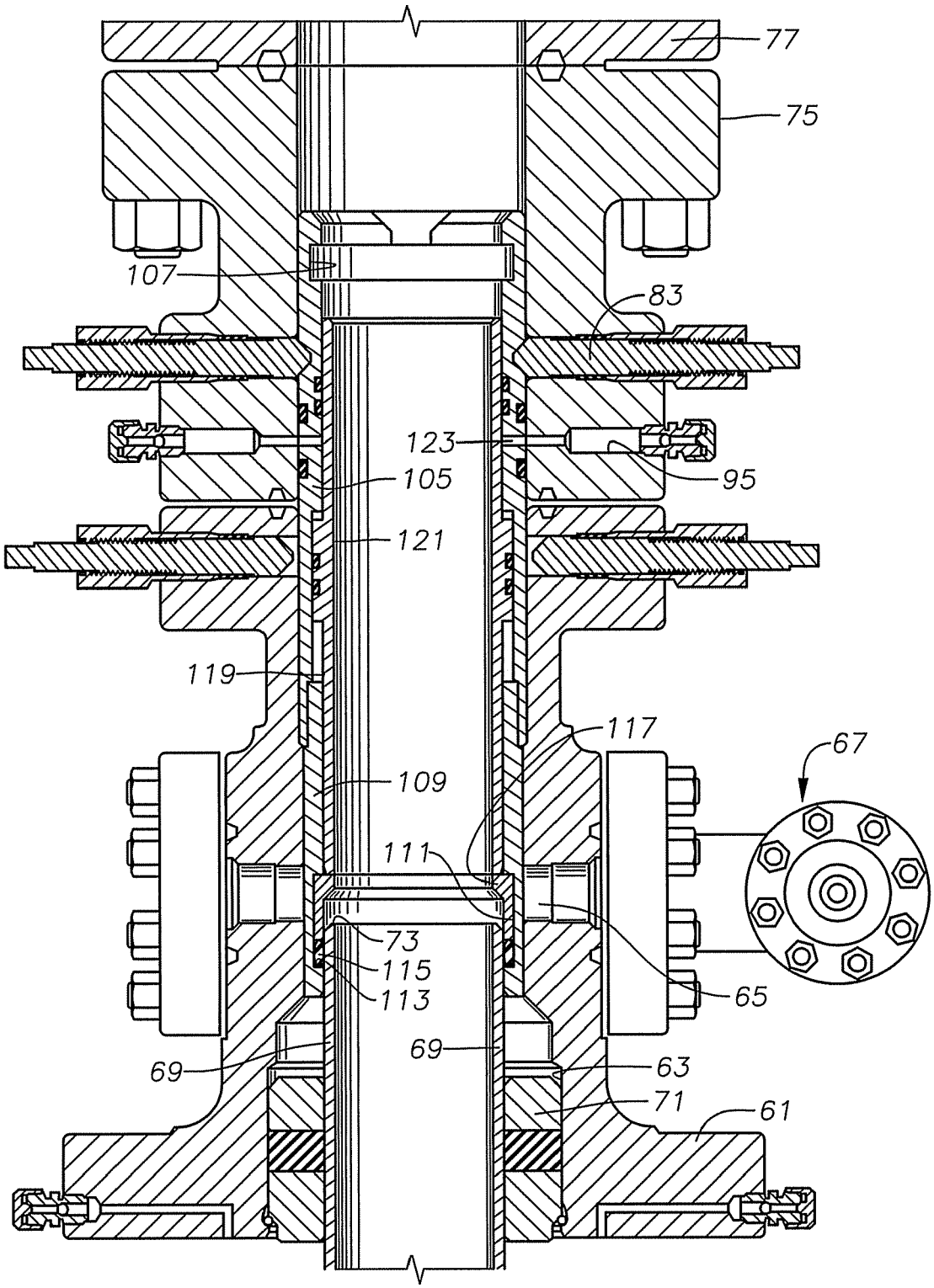
FIG. 5 is a sectional view of another embodiment of an isolation sleeve shown engaging a conduit in a wellhead.

Referring to FIG. 5, in this embodiment, wellhead 61 is the same as in FIG. 4, thus the same numerals are employed. Isolation sleeve 105 has a profile 107 for running and retrieving sleeve 105 in the same manner as sleeve 79 in FIG. 4. A seal carrier 109 is rigidly attached to sleeve 105 in this example. Seal carrier 109 has an outer diameter smaller than any portion of bore 63 of wellhead member 61 above seal carrier 109. The smaller outer diameter of seal carrier 109 allows it to be inserted into bore 63 simultaneously with sleeve 105. Seal carrier 109 has an interior annular recess 111 near its lower end. Recess 111 has an upward facing shoulder 113 on its lower end that supports a seal 115. The lower end of seal carrier 109 is sized to fit around the outer diameter of casing 69. Seal 115 has an initial inner diameter that permits it to slide easily over the outer diameter of casing 69.

Seal 115 is retained in recess 111 by an annular engagement member 117 that is capable of limited axial movement relative to seal carrier 109. Engagement member 117 has an inner diameter that is smaller than the inner diameter of sleeve 105 immediately above recess 111. A mandrel 119 is carried within the inner diameter of seal carrier 109 as well as sleeve 105. Mandrel 119 has a lower end that can contact the upper end of engagement member 117. Engagement member 117 and mandrel 119 could be attached or integrally formed together. An energizing piston 121 is formed on the outer diameter of mandrel 119. One or more sleeve ports 123 extend radially through sleeve 105 for registering with adapter port 95 in the same manner as in FIG. 4. Sleeve 105 is retained in adapter 75 by screws 83 in the same manner as in FIG. 4.

In the embodiment of FIG. 5, to energize seal 115, the operator supplies hydraulic pressure through port 95, which strokes mandrel 119 downward. The downward movement of mandrel 119 moves engaging member 117 downward, energizing seal 115 against the outer diameter of casing 69. The frac operation is performed in the same manner as the embodiment of FIG. 4.

Figure 6:
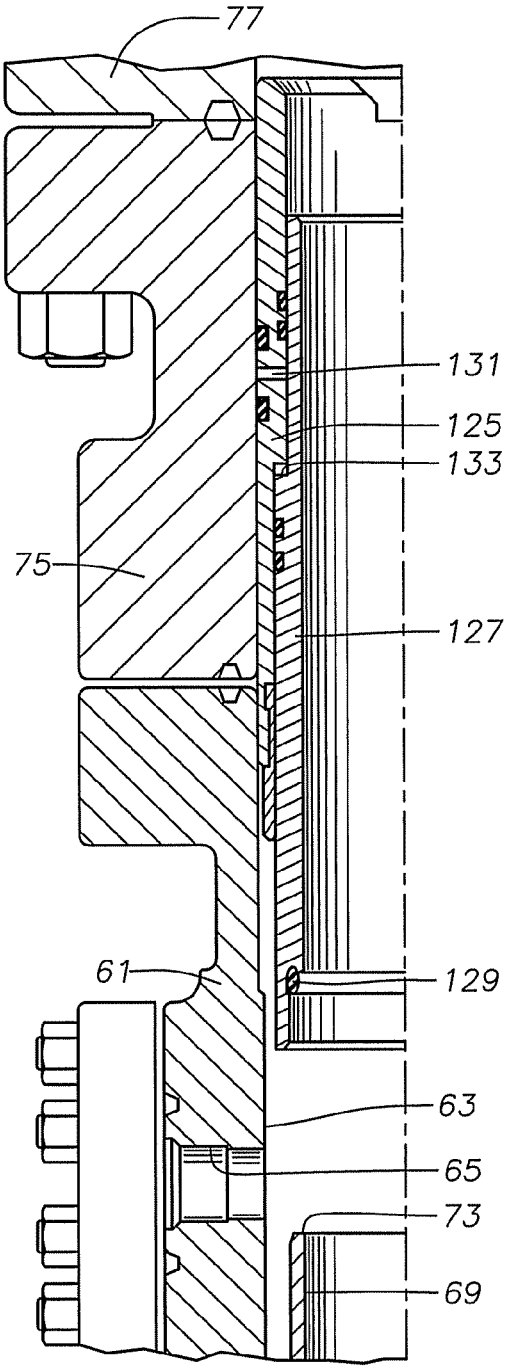
FIG. 6 is sectional view of the embodiment shown in FIG. 4, but connected to a transfer piston for moving the isolation sleeve into and out of the wellhead.

In the embodiment of FIG. 6, isolation sleeve 125 has a seal carrier 127 that is constructed in the same manner as shown in FIG. 4. Seal carrier 127 carries an elastomeric seal 129 within an annular recess on its inner diameter. Seal 129 is spaced a short distance above the lower end of seal carrier 127 in the same manner as in FIG. 4. The recess containing seal 129 is open on its downward end.

A sleeve port 131 extends through sleeve 125 to supply hydraulic fluid to an energizing piston 133 to stroke seal carrier 127 downward relative to sleeve 125. The embodiment of FIG. 6 differs from the embodiment of FIG. 4 in that sleeve 125 does not have a running and retrieval profile 81 as in FIG. 4. Rather sleeve 125 extends farther upward and has a transfer piston on it that is illustrated in FIG. 1 by the numeral 41. Piston 41 is located in a chamber 35 (FIG. 1).

When hydraulic fluid pressure is supplied to chamber 35, transfer piston 41 will stroke sleeve 125 and seal carrier 127 downward in unison from the upper position shown in FIG. 6. Sleeve 125 moves downward until it hits an upward facing shoulder in wellhead 61, which prevents further downward movement of sleeve 125. At this position, the lower end of seal carrier 127 will be extended over rim 73 of casing 69 and seal 129 will be close to or in contact with rim 73. The operator then supplies fluid pressure through port 131 to energizing piston 133 to move seal carrier 127 downward relative to sleeve 125 to deform seal 129 into sealing engagement with rim 73.

Figure 7:
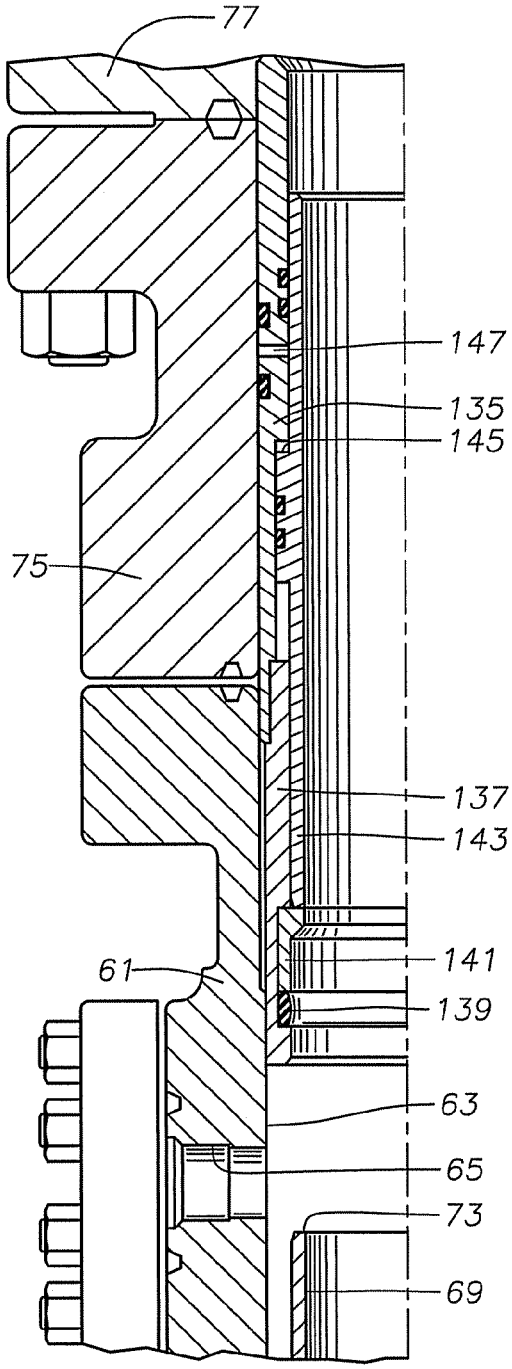
FIG. 7 is a sectional view of the isolation sleeve of FIG. 5, but shown connected to a transfer piston for moving the isolation sleeve into and out of the wellhead.

FIG. 7 illustrates an isolation sleeve 135 that has a seal carrier 137 constructed in the same manner as FIG. 5. Seal carrier 137 has an elastomeric seal 139 located in an inner recess for sealing against the outer diameter of tubing 73. Recess 139 has a closed lower end. An engagement member 141 is located in recess 139 in contact with and above seal 139. Engagement member 141 has an inner lip on its upper end that protrudes into the bore of sleeve 139. A mandrel 143 has an external annular piston 145 that is supplied with fluid pressure through a sleeve port 147 in sleeve 135. Mandrel 143 has a lower end that contacts the upper end of engagement member 141.

The embodiment of FIG. 7 differs from the embodiment of FIG. 5 in that sleeve 135 does not have a running and retrieval profile 107 as in the embodiment of FIG. 5. Rather, sleeve 135 extends upward and has a transfer piston, which is shown by the numeral 41 in FIG. 1, on its upper end. Transfer piston 41 is located in a chamber 35 (FIG. 1). When transfer piston 41 is supplied with hydraulic fluid pressure, it moves sleeve 135 along with seal carrier 137 downward as a unit from the upper position shown in FIG. 7. Seal carrier 137 and sleeve 135 move in unison until sleeve 135 contacts a shoulder in the bore of wellhead 61. In this position, seal 139 will be located on the outer diameter of casing 69. The operator supplies hydraulic fluid pressure through port 147 to piston 145, which moves mandrel 143 downward against engagement member 141 to energize seal 139.

The invention has significant advantages. The use of a hydraulic chamber and piston above the gate valve enables the operator to quickly stroke the isolation sleeve into and out of sealing engagement within the tubing head. If the operator prefers to use a running and retrieval tool rather than a hydraulic transfer piston, this also can be utilized. Two different embodiments show the lower end of the isolation sleeve extending around the upper end of the casing. This arrangement avoids the need for a secondary packoff in the tubing head around the casing. It also permits the seal to be energized by applying hydraulic pressure. Each of these two embodiment can be employed with a running tool or with a transfer piston.

While the invention has been shown in only a few of its forms, it should be apparent to those skilled in the art that it is not so limited but is susceptible to various changes without departing from the scope of the invention.

The invention claimed is:

1. An apparatus for protecting during fluid injection a bore of a wellhead member located at an upper end of a conduit extending into a well, comprising:

a tubular adapter assembly adapted to mount on the wellhead member, the adapter assembly having a flow passage for coupling to a source of fluid to be pumped into the conduit;

a sleeve having an upper end carried in the passage of the adapter assembly and a lower end protruding from the adapter assembly for insertion into the bore of the wellhead member;

a seal carrier carried by and located at a lower end of the sleeve, the seal carrier having an outer diameter smaller than any portion of the bore of the wellhead member so as to be inserted into the bore of the wellhead member simultaneously with the sleeve, the seal carrier having a bore dimensioned greater than an outer diameter of an upper end of the conduit to slide over the upper end of the conduit; and a seal within the bore of the seal carrier for sealing contact with an outer diameter of the conduit.

2. The apparatus according to claim 1, wherein the bore of the seal carrier has a recess formed therein, and the seal is located within the recess.

3. The apparatus according to claim 1, further comprising:

an energizing piston carried within the sleeve and the seal carrier for axial movement relative to the sleeve and the seal carrier, the energizing piston being carried by the sleeve when the sleeve is inserted into the bore of the wellhead member; and an engagement member on a lower end of the energizing piston that deforms the seal into the sealing engagement with the outer diameter of the conduit when the energizing piston is stroked downward relative to the sleeve and the seal carrier.

4. An apparatus for injecting fluid into a well, comprising:

a wellhead member having a bore and located at an upper end of the well, the wellhead member having at least one lateral passage extending through a side wall of the wellhead member into the bore;

a string of conduit suspended in the well, the conduit having an upper end extending into the wellhead member;

a packoff member sealing between an outer diameter of the conduit and the bore of the wellhead member below the lateral passage, the upper end of the conduit protruding above the packoff member;

a sleeve within the bore of the wellhead member, the sleeve having an upper portion that sealingly engages the bore of the wellhead member above the lateral passage;

a seal carrier at a lower end of the sleeve, the seal carrier having an outer diameter smaller than any portion of an inner diameter of the wellhead member, the seal carrier sliding over the upper end of the conduit when the sleeve is placed in the bore of the wellhead member, and the seal carrier having a lower end spaced above the packoff after the sleeve is installed in the bore of the wellhead member;

a seal within the seal carrier in sealing contact having an inner diameter in sealing contact with an outer diameter of the conduit below the lateral passage;

a tubular mandrel carried within the sleeve and the seal carrier when the seal carrier is inserted into the bore of the wellhead member;

an energizing piston mounted to the mandrel for axially moving the mandrel relative to the sleeve and the seal carrier; and an engagement member on a lower end of the mandrel that deforms the seal when the mandrel is stroked downward.

5. The apparatus according to claim 4, wherein the seal carrier and the sleeve are movable in unison with each other.

6. An apparatus for protecting during fluid injection a bore of a wellhead member, comprising:

an integral adapter body having an axial passage and a gate cavity that intersects the axial passage;

a sleeve having an upper portion carried within the axial passage;

a seal carrier carried by the sleeve at a lower end of the sleeve, the seal carrier and the sleeve being movable in unison with each other;

a gate in the gate cavity, the gate being movable in directions perpendicular to the axial passage between open and closed positions;

a chamber located in the axial passage above the gate;

a transfer piston within the chamber such that when fluid pressure is supplied to the chamber, the transfer piston strokes the sleeve and the seal carrier together relative to the adapter body between a lower position wherein the seal carrier is within the wellhead member and an upper position wherein the seal carrier is above the gate;

the seal carrier having a seal that forms a sealing relationship with an upward extending conduit in the wellhead member while the sleeve is in the lower position; and an energizing piston carried by the sleeve that when energized, moves relative to the sleeve and the seal carrier to force the seal into the sealing contact with the conduit.

7. The apparatus according to claim 6, wherein the seal carrier comprises:

an internal recess; and the seal being carried in the recess.

* * * * *